US007493845B2

(12) United States Patent
Mantas

(10) Patent No.: US 7,493,845 B2
(45) **Date of Patent: *Feb. 24, 2009**

(54) RECOIL MECHANISM FOR A GUN

(76) Inventor: Dimitrios Mantas, 37 Mikras Asias str. Argiroupoli, Athens (GR)

( * ) Notice: Subject to any disclaimer, the term of this patent is extended or adjusted under 35 U.S.C. 154(b) by 0 days.

This patent is subject to a terminal disclaimer.

(21) Appl. No.: 12/108,315

(22) Filed: Apr. 23, 2008

(65) Prior Publication Data

US 2008/0196289 A1 Aug. 21, 2008

Related U.S. Application Data

(63) Continuation of application No. 10/522,271, filed as application No. PCT/GR2004/000008 on Feb. 6, 2004, now Pat. No. 7,380,487.

(30) Foreign Application Priority Data

Feb. 6, 2003 (GR) ..... 20030100056

(51) Int. Cl.
*F41A 25/00* (2006.01)

(52) U.S. Cl. ..... 89/42.01; 42/74; 42/1.06; 42/97; 89/198

(58) Field of Classification Search ..... 42/1.06, 42/97, 74; 89/198, 42.01, 14.3
See application file for complete search history.

(56) References Cited

U.S. PATENT DOCUMENTS 898,038 A * 9/1908 Clarus ..... 89/196
3,731,590 A * 5/1973 Zimmerman, Jr. ..... 89/163
3,901,125 A * 8/1975 Raville ..... 89/163
4,031,808 A * 6/1977 Raville ..... 89/163
4,201,113 A * 5/1980 Seecamp ..... 89/199
4,485,723 A * 12/1984 Sarony ..... 89/163
4,754,689 A * 7/1988 Grehl ..... 89/196
4,972,760 A * 11/1990 McDonnell ..... 89/196
5,054,368 A * 10/1991 Wentzel et al. ..... 89/196
5,069,110 A * 12/1991 Menck ..... 89/198

* cited by examiner

*Primary Examiner*—J. Woodrow Eldred
*Assistant Examiner*—Gabriel J Klein
(74) *Attorney, Agent, or Firm*—Notaro & Michalos P.C.

(57) ABSTRACT

A recoil mechanism for a gun with a frame, a barrel and a slide, has a cylinder with a rear with external flange and an internal diaphragm spaced forwardly of the flange and between a rear chamber and a front chamber in the cylinder. A nut is fixed to the frame and an axle has a rear end threaded to the nut and extends in the cylinder. The axle has a collar trapped in the front chamber by the diaphragm. A first spring around the cylinder, has a front end abutting the slide and a rear end abutting the flange. A second spring extending at least partly in the rear chamber has a rear end abutting the nut and a front end abutting the diaphragm. A third spring in the front chamber, is shorter in length than the front chamber. A recoil adjusting plug is used with or without the recoil mechanism.

8 Claims, 3 Drawing Sheets

RECOIL MECHANISM FOR A GUN

CROSS-REFERENCE TO RELATED APPLICATIONS

This is a continuation-in-part of U.S. patent application Ser. No. 10/522,271 filed Jan. 25, 2005 and now U.S. Pat. No. 7,380,487, which was a 371 application of PCT/GR2004/000008 filed Feb. 6, 2004, both of which are incorporated here by reference, and which claims priority on Greek patent application 20030100056 filed Feb. 6, 2003, which priority claim is repeated here.

FILED AND BACKGROUND OF THE INVENTION

A invention concerns a recoil mechanism for reducing the recoil of a gun. When a gun, as a mechanical system, is fired, the bullet travels along the gun's barrel and exits its muzzle. The resulting reactive force is imparted to the gun in the form of recoil. Apart from the gun's recoil phenomenon which is caused upon firing in the chamber because of the bullet's charge, the produced explosion gives to the gun's frame an instantaneous kinetic energy, annihilating any inertia phenomenon, which was prevailing in the reference system between the gun and the user before the explosion.

For the avoidance of the recoil phenomenon the current technology for portable guns like semi-automatic pistols, automatic pistols, submachine-guns and/or other heavy weaponry, the recoil systems, use in most cases, a recoil spring. Different technical solutions are used for the increase of the inertia of the reference system between the gun and the user, which nevertheless are restricted to small improvements in the present case, like:

1. By the addition of a mercury pouch on the gun's front end, so as to cause vertical resultant force, in order to increase the gun's inertia over the gun-barrel's recoil.

2. By gas escape from blow holes of the gun-barrel's top with a direction opposite of the gun's recoil direction upon shooting.

SUMMARY OF THE INVENTION

The invention is a recoil mechanism for a gun that reduces the adverse effect of recoil. The invention is based on a magnet's presence, which in cooperation with successive springs, of the same or different diameter, of coil or wire type, controls the acceleration and the deceleration of the slide's reciprocating motion in a gun. Also by the mechanical only method, wherein one of the successive springs, having the same axial or another axial arrangement level and in succession with the mentioned successive springs, takes part in the motion, with a time lag. This happens because the ends of one of the springs do not abut from the beginning reference points in the gun, but only after the firing of each bullet. The result of all this function is the greatest possible control of the gun's recoil.

The invention also includes a new recoil spring plug that is threaded to the front end or to the rear end of the recoil spring for adjusting the biasing force exerted by the recoil spring, by deactivating the coils of the spring that have been threaded into the plug. By threading more or less of the spring into the plug, the recoil bias of the spring can be adjusted so that the recoil action can be tuned. The recoil spring plug can be used with the recoil mechanism of the invention or alone in a conventional recoil mechanism.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE INVENTION

Figure 1:
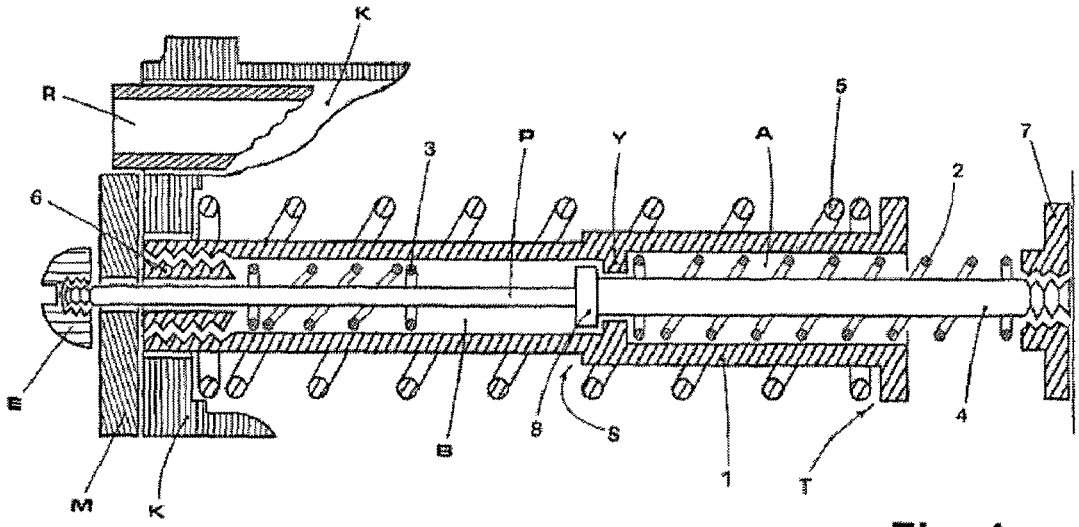
FIG. 1 is a longitudinal sectional view of a first embodiment of a recoil mechanism for a gun according to the invention.
Figure 2:
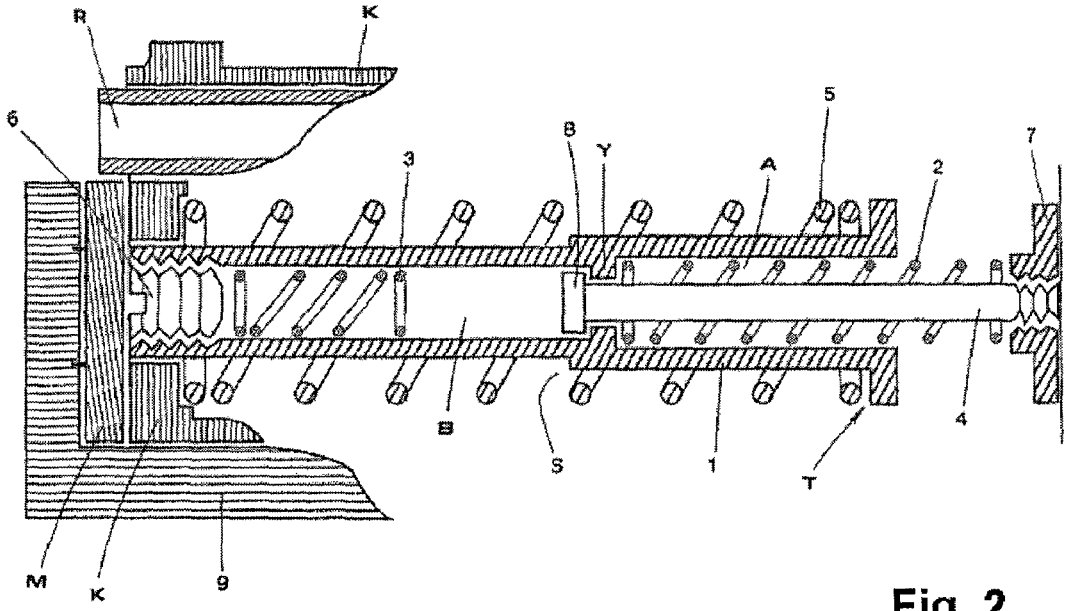
FIG. 2 is a longitudinal sectional view of a second embodiment of the recoil mechanism according to the invention.

Referring to the drawings, FIGS. 1 and 2 illustrate two embodiments of a recoil reduction mechanism for a gun, which both include a cylinder 1 having a large diameter portion that extends into a first spring 5. The cylinder 1 is divided, by a diaphragm Y into two chambers, namely, a first or rear chamber A in the large diameter portion and a second or front chamber B in a small diameter portion of the cylinder 1. In the embodiment of FIG. 1, an axle 4 extends in both chambers A and B, and in the embodiment of FIG. 2 the axle 4 extends only in the first chamber A. A second, small diameter spring 2 is inserted in the first chamber A and a third, small diameter spring 3 is inserted in the second chamber B. A set screw 6 closes one end of chamber B and a rear end of axle 4 that is opposite from chamber B is threaded into a round nut 7 to fix the axle to the frame to which the nut 7 is fixed. This rear end of the axle 4 abuts the frame of the gun and by extension it abuts on the gun's handgrip. In the embodiment of FIG. 1, an extension P of the axle 4 penetrates the set screw 6 and forms part or all of the base for the support of a magnet M, which magnet is locked by a locking nut E threaded to the front end of the axle extension P. Lines of magnetic force of magnet M, attract the front end of the slide K of the gun. In the embodiment of FIG. 2, there is no axle extension but the magnet M is supported on a base 9 of the gun.

In FIG. 1 the recoil mechanism for the gun having a gun-barrel R and the slide K, comprises the large diameter portion of cylinder 1 extending into the first spring 5 which has a rear end that abuts a flange T of the cylinder 1. Spring 5 has a large diameter, and its opposite front end abuts the gun's slide K. The axle 4 is immobilized by its rear end being fixed in the nut 7 and by including a collar 8 in the chamber B, forward of the diaphragm Y.

The second spring 2 in chamber A has a front end that abuts diaphragm Y and a rear end that abuts nut 7.

When the springs 5 and 2 are installed in the slide K they are under a minimum compression. The third spring, 3 is positioned in chamber B and is trapped by the set screw 6, but since the length of the spring is shorter than chamber's length, the two ends of the spring 3 are at a distance, on the one hand, from the set screw's surface, and on the other hand, from the collar's surface.

The system's function upon firing is as follows.

An instant before the firing of the gun, the spring 2 and the spring 5 are under minimum compression while the spring 3, which is positioned in the chamber B, is under zero compression. The front surface of the slide K under the gun-barrel muzzle and the front surface of the cylinder 1, adjoin the magnet M.

Upon firing the force of the gases generated in the gun-barrel and on the slide, reach a point that overcomes the attraction between the magnet M and the slide K. The slide is then violently set into rearward motion, cutting the lines of force between it and the magnet. This start of the recoil action compresses the spring 5 which pushes the cylinder 1 to the rear. The spring 2, and the magnet's attraction, does not permit the cylinder 1 to move immediately to recoil. Thereby the slide K continues its recoil until it hits a step S between the large and small diameter portions of the cylinder 1.

At step or point S of the cylinder 1, the slide K hits the cylinder 1, and further compression of spring 5 is interrupted. As the gases continue to increase their pressure in the gun-barrel, they get to the point which is critical for the magnet's attraction on the cylinder. Here, the continuous recoil of the slide sets also the cylinder 1 to recoil, and pulls it away from the magnet M.

Upon this phase, the slide K, the spring 5, the cylinder 1 and the set screw 6, recoil as an assembly which compresses the spring 2. Since the axle 4 is not moving towards any direction and since the cylinder 1 recoils, compressing meanwhile the spring 2, the set screw 6, because of the fact that it is screwed in the cylinder 1, reduces the space that contains the spring 3 in the chamber B between the set screw 6 and the collar 8. Up to this moment, wherein the expansion takes place from the bullet's firing, and which expansion acts over the slide K, only two springs function as a retroaction system, since they are positioned successively, to wit the first spring 5 and the second spring 2 function as one. Since the slide's recoil is continued with decelerated movement, and with the movement of the cylinder also, and while the spring 2 approaches ⅗ completion, then the third spring 3 abuts on the set screw 6 and the collar 8. The decelerated movement of the slide K and of the cylinder 1 meets the third spring 3 in total inertia, hence the spring 3 absorbs the most of the rest of the slide's recoil energy, before the spring 3 compresses to its maximum extent.

The result is that any further recoil of the slide before it hits the frame and since the gases' expansion is completed, the cylinder 1 and the slide K begin to move in opposite directions, with maximum acceleration, with the further result being improved firing speed of the gun. This is caused by the inertia of spring 3, which acts as an extra powerful suspension against the slide, with direction opposite of the slide's recoil direction, hence minimizing the intensity and the duration of the recoil. The time lag, which is caused by the magnet's presence, causes the gases' maximum expansion and gives bigger initial speed to the bullet, with the consequence of the bullet's firing range increasing. The spring 3 has also positive effect on the slide's axial motion, since the slide's time of roll back to the initial position is faster.

Beyond the magnet's mentioned support method by the axle's extension, another magnet support method is by the use of a base, like the base 9 of FIG. 2. In this case the base 9 is locked on the frame of the gun so as to be immovable and on which base the magnet M is positioned and attracts the cylinder 1 and the slide K. In this case, the extension of the axle doesn't need to be extended to the magnet, as this is depicted in FIG. 2.

The system may function also without a magnet, by using only the mechanical parts, but in this case the bullet will not have longer firing range.

Since the invention being expanded beyond its limits, but by the proper forming of the invention's main parts, like the cylinder's and axle's shape, the springs' resistance force and dimensions, while the spring 3 maintains the specifications of its freedom, the system can fit any gun type.

Figure 3:
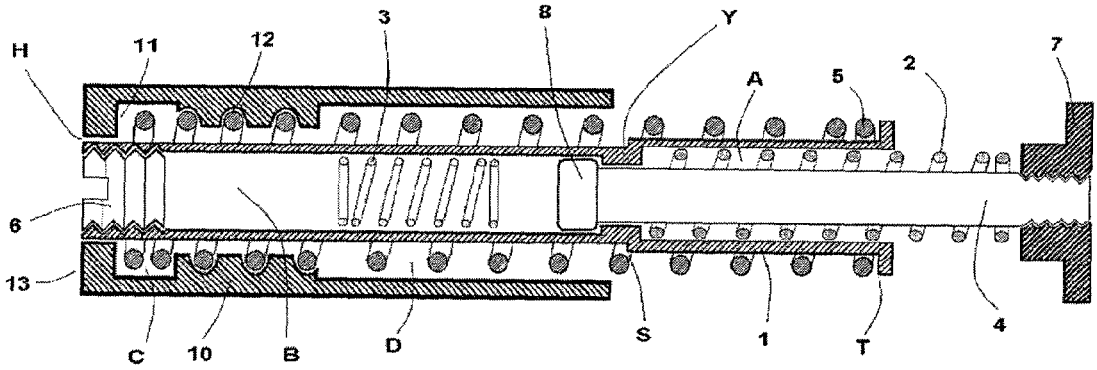
FIG. 3 is a sectional view of a recoil spring plug of the invention.

Turning now to FIG. 3, the embodiment illustrated includes a recoil spring plug 10 that is used in combination with the recoil mechanism of FIG. 1 or 2, or in combination with any known recoil mechanism, including a single recoil spring that is effective between the slide and the frame of a gun.

Plug 10 has a rear chamber D that is open toward the rear of the gun and that receives the front portion of the first, main or only recoil spring 5. The rear chamber D has a preferably cylindrical inner surface with a diameter that is large enough to receive the spring 5 for free compression of the spring 5 in chamber D during a firing cycle. Plug 10 also has a front chamber C that has the same or a similar diameter as the rear chamber D for freely receiving one or more turns or coils of a front end of spring 5, in the front chamber C. A small diameter intermediate chamber in plug 10 has a helical groove 12 with two or more turns into which turns of spring 5 are screwed or threaded. In order to reduce the biasing effect of spring 5 and thus "tune" the recoil effect of the main recoil spring 5, a number of turns of spring 5 are screwed into groove 12 until one or more front turns of the spring 5 are in front chamber C. Chamber C thus acts as a storage chamber for these front turns.

The front turns of spring 5 can be compressed in chamber C if, by screwing spring 5 into groove 12, the front end of spring 5 engages an inner surface 11 if a front wall of plug 10. This effectively eliminates the turns of spring 5 that are in groove 12 and in chamber C, from contributing their biasing effect to the counter-recoil effect of spring 5 during a firing cycle of the gun. A user of the gun can thus change the extent to which the spring 5 is screwed into groove 12 until the desired recoil effect if achieved.

In FIG. 3 the front wall of plug 10 has an opening or hole H to receive the front small diameter portion of cylinder 1 when the gun is fired. The recoil motion of the plug to the right in FIG. 3 continues until the inner surface 11 around hole H contacts the step or point S in cylinder 1.

The outer front surface 13 of plug 10 engages the front inner surface of the gun slide (not shown) or the inside surface of the base in an embodiment that combines the plug 10 with the recoil mechanism of FIGS. 1 and 2.

Figure 4:
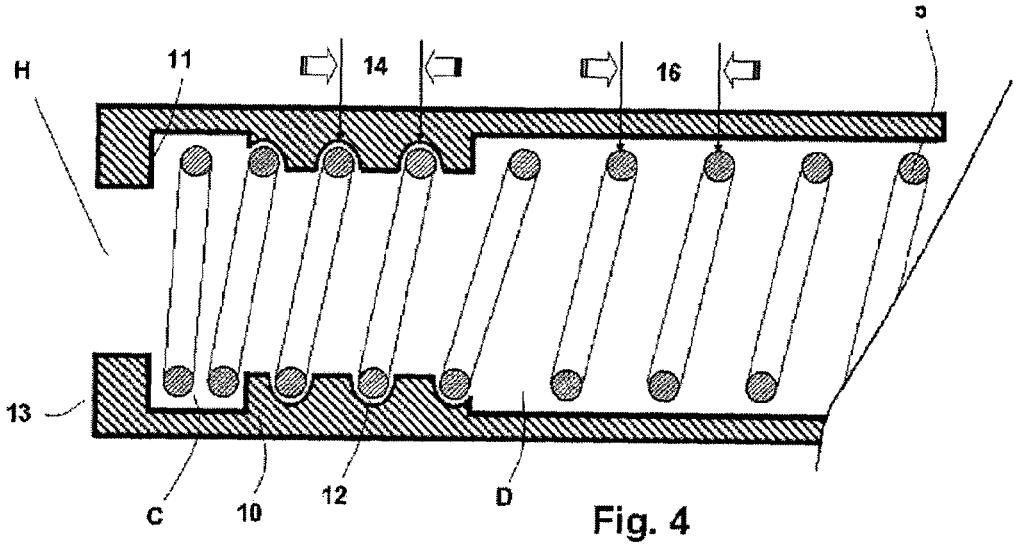
FIG. 4 is an enlarged sectional view of the engagement of the recoil spring turns in the plug that further illustrations the locking action between the plug and spring which is increased even further upon firing of the gun in order to maintain the relative position between the plug and the spring.

As shown in FIG. 4, the distance 14 between the turns of groove 12 are shorter than distance 16 between the turns of spring 5 in its un-compressed condition. This has the effect of locking the spring 5 in the groove 12 since the turns of spring 5 in groove 5 must be compressed. This locking effect prevents the spring 5 from turning in groove 12 and thus losing its selected tuning during repeated firings of the gun.

Said in another way, the pitch or distance between turns of the groove 12, which is shown at 14 in FIG. 3, is preferably less than the pitch 16 of spring 5 so that the turns of the spring 5 are threaded into the groove 12 under compression. Alternatively the groove pitch 14 may be longer than the spring pitch 16 so that the spring 5 is seated in groove 12 under extension. In each case the pre-biasing of the spring 5 inside the groove 12 insures that the plug is securely engaged to the spring to avoid undesired relative rotation between the plug and spring, even after repeated firing cycles of the gun.

In inventor has found that this locking effect is even further advanced when the gun is fired since the further strong compression of spring 5 during recoil, dynamically locks the plug to the spring even further.

The purpose of the plug is to allow the user of the gun to adjust the recoil dias of spring 5. This ability to tune the recoil is advantageously in many gun types, and in particular for the very widely used M1911 0.45 ACP pistol.

Figure 5:
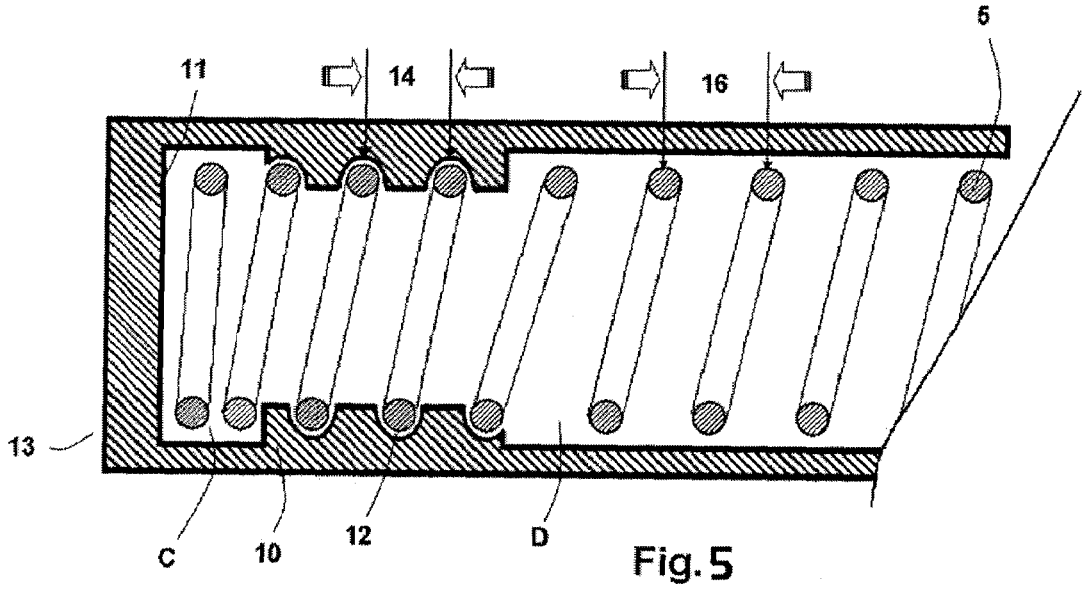
FIG. 5 is a view similar to FIG. 4 of another embodiment of the plug.

FIG. 5 illustrates an embodiment of the plug 10 with no hole in the front wall so that the inner and outer surfaces 11, 13 are continuous. This embodiment is particularly suited to the standard model 1911 short guide rod.

Figure 6:
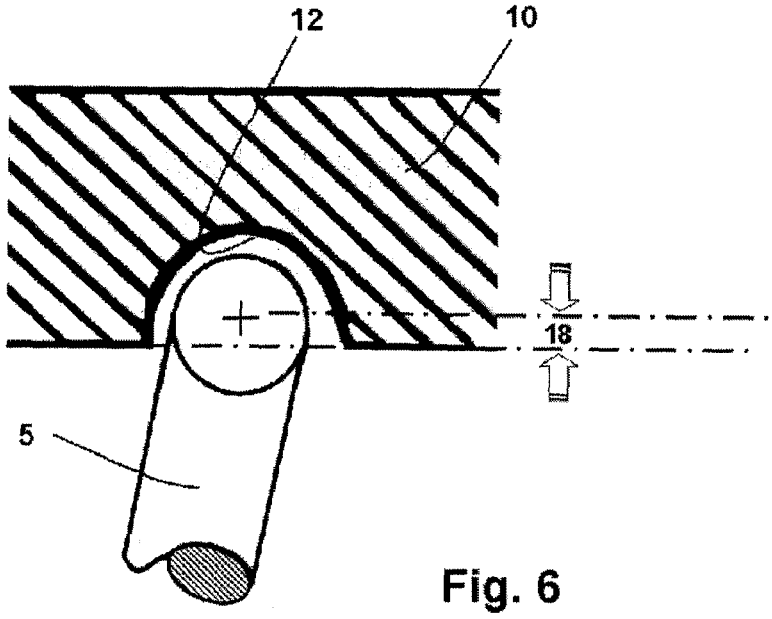
FIG. 6 is a greatly enlarged view showing the engagement of one coil of the recoil spring in one groove of the plug.

To further enhance the engagement between the turns of coils of spring 5 and the groove 12, and as shown in FIG. 6, the groove 12 has a semi-circular cross-section that is deeper by a small amount 18, than the radius of the spring wire cross-section. This deep seating of the spring coils helps further fix the plug 10 against relative rotation with the spring 5.

While specific embodiments of the invention have been shown and described in detail to illustrate the application of the principles of the invention, it will be understood that the invention may be embodied otherwise without departing from such principles.

What is claimed is:

1. A recoil mechanism for a gun having a frame with a barrel and a slide that is movable rearwardly of the frame and barrel, when the gun is fired, the mechanism comprising:

a cylinder having a rear end with an external flange and an internal diaphragm spaced forwardly of the flange and disposed between a rear chamber and a front chamber both defined in the cylinder;

a nut;

an axle extending in the cylinder, the axle having a rear end fixed to the nut and a collar spaced forwardly of the rear end and being forward of the diaphragm and trapped in the front chamber by the diaphragm;

a first spring around the cylinder, the first spring having a front end abutting the slide and a rear end abutting the flange;

a second spring extending at least partly in the rear chamber and having a rear end abutting the nut and a front end abutting the diaphragm; and a third spring in the front chamber, the third spring being shorter in length than the front chamber;

the front chamber having a front entry end and a set screw closing the front entry end of the front chamber;

wherein upon firing of the gun, a force of gases in the barrel acting on the slide to move the slide in the rearward recoil direction, rises to a point that the slide starts to move in the rearward recoil direction, and, after a time lag, the slide engages the cylinder causing the cylinder to also move in the rearward recoil direction;

the time lag being selected to allow a maximum expansion of gases from the barrel for propelling a bullet from the barrel while the slide recoils, so that the bullet has improved range;

the third spring functioning in the front chamber to become compressed later during the recoil of the slide to absorb a remainder of recoil energy of the slide, for decelerating any further recoil of the slide, with most recoil energy of the slide being absorbed by a progressive compression of the first spring and the second spring.

2. The recoil mechanism of claim 1, including an extension of the axle in the front chamber, extending through the set screw, and a locking nut threaded to a front end of the extension for fixing the axle to the frame, and a base fixed to the frame.

3. The recoil mechanism of claim 1, wherein the nut is a round nut.

4. The recoil mechanism of claim 1, including a plug having an inner cylindrical surface with a helical groove for receiving and thereby deactivating a bias of a plurality of turns of the first spring.

5. The recoil mechanism of claim 1, including a plug having an inner cylindrical surface with a helical groove for receiving and thereby deactivating a bias of a plurality of turns of the first spring, the groove and the first spring each having a pitch, the pitch of the groove and the first spring being different for better fixing the plug against relative rotation with respect to the first spring.

6. The recoil mechanism of claim 1, including a plug having an inner cylindrical surface with a helical groove for receiving and thereby deactivating a bias of a plurality of turns of the first spring, the groove and the first spring each having a pitch, the pitch of the groove and the first spring being different for better fixing the plug against relative rotation with respect to the first spring, the groove having a semi-cylindrical cross-section that is deeper than a radius of a wire making up the first spring.

7. The recoil mechanism of claim 1, including a plug having an inner cylindrical surface with a helical groove for receiving and thereby deactivating a bias of a plurality of turns of the first spring, the plug including a rear chamber for receiving a rear portion of the first spring for free compression of the rear portion of the first spring, the plug including a front chamber for receiving a front portion of the first spring, the plug having an intermediate chamber between the front and rear chambers which contains the helical groove.

8. The recoil mechanism of claim 1, including a plug having an inner cylindrical surface with a helical groove for receiving and thereby deactivating a bias of a plurality of turns of the first spring, the plug including a rear chamber for receiving a rear portion of the first spring for free compression of the rear portion of the first spring, the plug including a front chamber for receiving a front portion of the first spring, the plug having an intermediate chamber between the front and rear chambers which contains the helical groove, the groove and the first spring each having a pitch, the pitch of the groove and the first spring being different for better fixing the plug against relative rotation with respect to the first spring, the groove having a semi-cylindrical cross-section that is deeper than a radius of a wire making up the first spring.

* * * * *